United States Patent [19]

Van Sloun et al.

[11] Patent Number: 4,489,654

[45] Date of Patent: Dec. 25, 1984

[54] HYDRODYNAMIC FIRING PIN

[75] Inventors: Peter H. Van Sloun, Hopkins; James C. Hall, Buffalo, both of Minn.

[73] Assignee: Honeywell Inc., Minneapolis, Minn.

[21] Appl. No.: 462,857

[22] Filed: Feb. 1, 1983

[51] Int. Cl.[3] ..... F42C 19/08

[52] U.S. Cl. ..... 102/204; 102/200

[58] Field of Search ..... 102/204, 200, 202.5, 102/202.6, 275.6, 275.11, 318, 322, 340, 342, 351, 357, 483, 504, 505; 42/1 F

[56] References Cited

U.S. PATENT DOCUMENTS

| | | | |
|---|---|---|---|
| 2,415,803 | 2/1947 | Abell | 102/204 |
| 4,099,465 | 7/1978 | Haake | 102/204 |
| 4,286,521 | 9/1981 | Marer | 102/204 |

*Primary Examiner*—Charles T. Jordan

*Attorney, Agent, or Firm*—George W. Field

[57] ABSTRACT

In combination: an explosive propulsion member having an axial percussion primer; an electric primer mounted to discharge toward the percussion primer along the axis; and apparatus between the primers hydrodynamically responsive to discharge of the electric primer to percussively engage the percussion primer.

5 Claims, 2 Drawing Figures

HYDRODYNAMIC FIRING PIN

FIELD OF THE INVENTION

This invention relates to the field of armaments, and more particularly to apparatus for dispensing groups of cargo items such as mines.

BACKGROUND OF THE INVENTION

In military operations it is frequently desirable to dispense from a vehicle, such as a helicopter or a truck, sets of cargo items such as mines, to be distributed over the area being traversed by the vehicle.

A known way of doing this is to stow the items in a tube having a first, generally closed end, a sliding obturator being provided between the cargo and the closed end. When gas pressure is provided against the obturator, it moves in the tube and the cargo items are dispensed at the other end of the tube.

To provide the necessary pressure there has been developed what is known as a high-pressure/low-pressure system. Here a high pressure volume is in communication with a low-pressure volume, the latter comprising the space in the tube between the obturator and the closed end, and the former being a chamber outside the closed end of the tube and containing a shell. Discharge of the propulsion member creates a quantity of gas at high pressure in the first named volume, which passes to the second named volume and drives the obturator to expel the cargo elements. It has been convenient to trigger the discharge of the shell by an electric primer apposed to a percussion primer in the shell.

For reasons of safety during storage, transportation, and handling, means must be provided to prevent any premature operation of the electric primer from setting off the propulsion member. Such means must be capable of disabling the electric primer from triggering the percussive primer in a first condition, and of acting as a firing pin between the electric primer and the percussion primer in a second condition.

SUMMARY OF THE INVENTION

The present invention comprises means for hydrodynamically percussing a percussive primer in response to discharge of an electric primer in line therewith. The means is moveable between first and second positions, in one of which it disables the electric primer from affecting the percussive primer and in the other of which it performs its firing function.

Various advantages and features of novelty which characterize the invention are pointed out with particularity in the claims annexed hereto and forming a part hereof. However, for a better understanding of the invention, its advantages, and objects attained by its use, reference should be had to the drawing which forms a further part hereof, and to the accompanying descriptive matter, in which there is illustrated and described a preferred embodiment of the invention.

BRIEF DESCRIPTION OF THE DRAWING

In the drawing, in which like reference numerals identify corresponding parts throughout the several views, FIG. 1 comprises a somewhat schematic longitudinal section of a portion of a cargo dispenser embodying the invention, and FIG. 2 comprises a fragmentary view to a larger scale showing a different position of the apparatus.

DESCRIPTION OF THE PREFERRED EMBODIMENT

Figure 1:
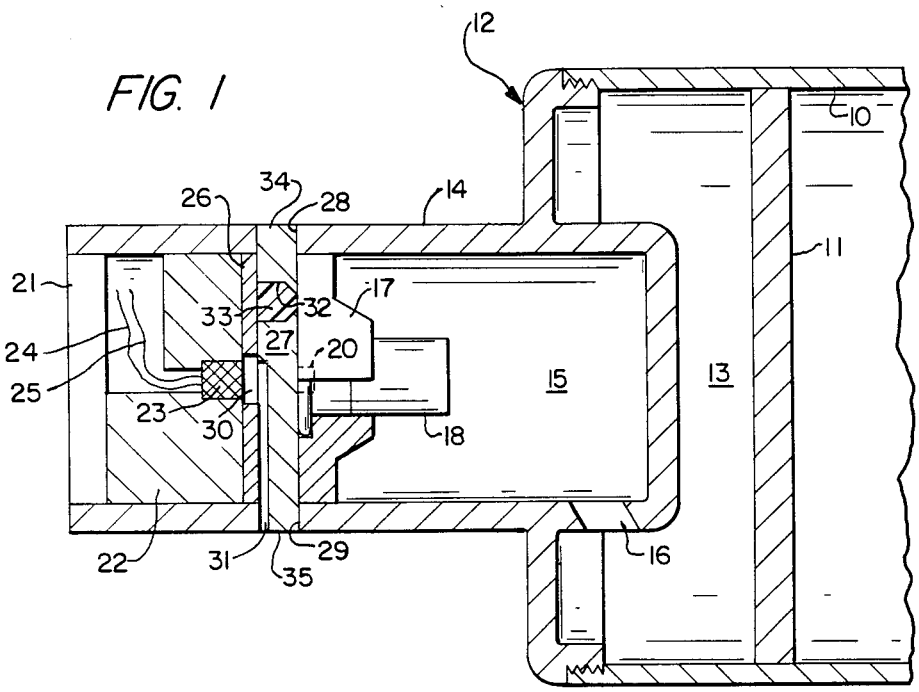

Turning now to FIG. 1, a cylinder 10 for discharging cargo elements, not shown, axially toward the right contains an obturator 11 which sealingly slides therein. The cylinder has a closed end 12 which defines with obturator 11 a low pressure chamber 13.

End 12 includes a housing 14 which encloses a high pressure chamber 15 connected with chamber 13 by a channel 16 of predetermined cross-sectional area. Secured in any suitable fashion in housing 14 is a breech block 17 arranged to receive an explosive propulsion member in the form of a blank shotgun shell 18 having the usual center fire percussion primer 20.

The end of housing 14 remote from shell 18 is closed by a plug 21 which bears against a mounting member 22 carrying at its center an electric primer 23 having conductors 24 and 25 to be connected to an electric firing mechanism in any conventional fashion.

Between member 22 and block 17 is a disk 26 having a diametrical groove of rectangular cross section, opening toward block 17, in which a slider 27 is mounted for movement transverse of the disk. Suitable detent means not shown may be provided for maintaining slider 27 in a first or "safe" position, in which its ends are substantially flush with the outer surface of housing 14. The housing has diametrically opposite openings 28 and 29 through which the ends of slider 27 may pass.

Disk 26 has a central aperture 30 axially aligned with primer 23, and slider 27 has a groove 31 extending from aperture 30 to the ambient atmosphere, in the "safe" position of the slider. Note that in that slider position a solid metallic barrier is present between primers 20 and 23, to prevent any premature firing of primer 23 from affecting primer 20, and the groove 31 in this situation discharges any gaseous products from the mechanism.

A bore 32 passes through slider 27, at a site radially displaced from aperture 30 when the slider is in its "safe" position. This bore receives a body 33 of resilient material which reacts in a hydrodynamic mode, such as silicon RTV. One suitable material is "Dow Corning RTV-732." The slider may be displaced radially, in the downward direction as seen in FIG. 1, by any conventional arming mechanism, into a second or "armed" position in which bore 32 is brought into alignment with primers 20 and 23, the upper end 34 of slider 27 being then below the surface of housing 14 and the lower end 35 of the slider projecting outward beyond the surface of the housing, to give a visual indication that the slider is in its armed position: for this purpose lower end 35 may be given a coating of paint of contrasting color.

Figure 2:
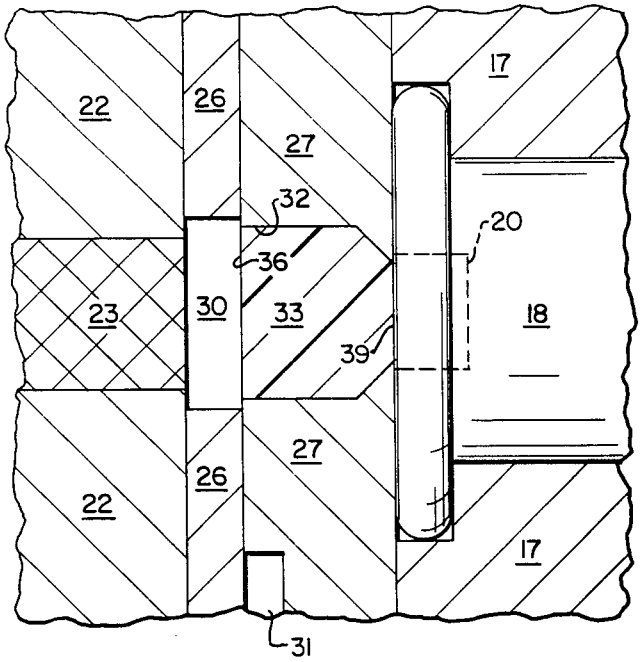

In FIG. 2 slider 27 is shown in its "armed" position in which body 33 is positioned between primer 23 and primer 20, in line with aperture 30. Bore 32 is configured to radially contain body 33, which has a larger end 36 apposed to primer 23 and a smaller end 39 apposed to primer 20.

OPERATION

To use the device, obturator 11 is inserted into tube 10, followed by the desired number of cargo items which force the obturator toward end 12. A temporary closure may be applied to the open end of tube 10 if desired. Plug 21, member 22, disk 26, and slider 27 are removed, and a blank shotgun shell is inserted into block 17. Disk 26 is positioned with its transverse groove aligned with openings 28 and 29 in casing 14, and a slider 27 containing a body 33 of silicon RTV or other suitable material is passed into the groove in the disk until suitably detented in its "safe" position. An electric primer 23 is inserted into mounting member 22, and the member and plug 21 are assembled to the housing. The loaded container may now be handled as an artillery round in storage and transportation, its "safe" condition being visually made evident by the fact that slider 27 is entirely within housing 14.

When it is desired to use the dispenser, it is installed in an appropriate launcher, with conductors 24 and 25 suitably connected to an electrical control, and slider 27 associated with a linear mechanical actuator: any temporary tube closure is now removed. After the launcher is loaded with the desired number of dispensers, the vehicle carrying the launcher may move to the intended launch area.

When the dispenser is to be discharged, slider 27 is mechanically actuated out of its "safe" condition into its "armed" condition, bringing body 33 between and into apposition with primers 23 and 20. Now electric primer 23 may be discharged when desired, and its force acting on large end 36 of body 33 is hydrodynamically transmitted through the body to small end 39, extruding a portion of the body into percussive engagement with primer 20, to fire shell 18. The resulting gases are conducted from chamber 15 to chamber 13 through connection 16, at such a rate as to forcefully displace obturator through tube 10 and dispense the cargo items contained in the tube, the vigor of this dispensing being determined by the pressure in chamber 15, the ratio of the chamber volumes, and the size of connection 16.

From the above it will be seen that the invention comprises apparatus and a method for firing an explosive propulsion device having a percussion primer, including a hydrodynamic firing pin and an arrangement for providing a safety condition in which discharge of the propulsion device is inhibited. The apparatus is of one-piece construction, thus obviating the technical problems associated with providing a mechanical firing pin and insuring its safety.

We claim:

1. In combination:

an explosive propulsion member having an axial percussion primer;

an electric primer mounted to discharge toward said percussion primer along the axis thereof;

a safing mechanism between said primers including a radially contained body of highly viscous material;

and means mounting said mechanism for movement transverse to said axis between a first position, in which said body is on said axis, and a second position, in which said body is displaced from said axis, so that when said mechanism is in said first position and said electric primer is discharged, said body is hydrodynamically propelled against said percussion primer to cause it to fire.

2. Apparatus according to claim 1 in which said body is configured to have a smaller transverse section apposed to said percussion primer and a larger transverse section apposed to said electric primer.

3. Apparatus according to claim 1 in which said mechanism comprises a rigid mass between said primers in said second position thereof.

4. Apparatus according to claim 1 including means normally maintaining said mechanism in said second position, and arming means operable to move said mechanism into said first position.

5. Apparatus according to claim 4 in which said material is silicon rubber.

* * * * *